US011308918B2

(12) United States Patent
Huard et al.

(10) Patent No.: US 11,308,918 B2
(45) Date of Patent: Apr. 19, 2022

(54) SYNCHRONIZATION BETWEEN ONE OR MORE DISPLAY PANELS AND A DISPLAY ENGINE

(71) Applicant: INTEL CORPORATION, Santa Clara, CA (US)

(72) Inventors: Douglas Robert Huard, Portland, OR (US); Paul S. Diefenbaugh, Portland, OR (US); Vishal R. Sinha, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 16/914,334

(22) Filed: Jun. 27, 2020

(65) Prior Publication Data

US 2020/0335062 A1 Oct. 22, 2020

(51) Int. Cl.

| | |
|---|---|
| ***G09G 5/12*** | (2006.01) |
| ***G09G 5/00*** | (2006.01) |
| ***G09G 5/18*** | (2006.01) |

(52) U.S. Cl.

CPC ..... *G09G 5/12* (2013.01); *G09G 5/005* (2013.01); *G09G 5/18* (2013.01); *G09G 2330/021* (2013.01); *G09G 2340/0435* (2013.01); *G09G 2360/04* (2013.01); *G09G 2360/18* (2013.01); *G09G 2370/20* (2013.01)

(58) Field of Classification Search

CPC ..... G09G 5/006; G09G 5/12; G09G 5/18; G09G 2340/0435; G09G 2360/04; G09G 2370/20; G09G 5/005; G09G 2360/18; G09G 2330/021

See application file for complete search history.

(56) References Cited

U.S. PATENT DOCUMENTS

| | | | | |
|---|---|---|---|---|
| 2014/0253537 | A1* | 9/2014 | Lee | G09G 5/003 345/214 |
| 2019/0045088 | A1* | 2/2019 | Ansari | H04N 5/04 |
| 2019/0051269 | A1* | 2/2019 | Kwa | G09G 5/006 |

* cited by examiner

*Primary Examiner* — Xuemei Zheng

(74) *Attorney, Agent, or Firm* — Patent Capital Group

(57) ABSTRACT

Particular embodiments described herein provide for an electronic device that includes a display panel. The display panel includes a timing controller (TCON) and a synchronization engine. The TCON can generate a video stream of video frames with a frame rate and the synchronization engine is configured to change the frame rate of the video stream by adding vertical blanking lines to or removing vertical blanking lines from video frames in the video stream.

17 Claims, 7 Drawing Sheets

SYNCHRONIZATION BETWEEN ONE OR MORE DISPLAY PANELS AND A DISPLAY ENGINE

TECHNICAL FIELD

This disclosure relates in general to the field of computing, and more particularly, to the synchronization of one or more display panels and a display engine.

BACKGROUND

End users have more electronic device choices than ever before. A number of prominent technological trends are currently afoot and these trends are changing the electronic device landscape. Some of the technological trends involve a device that includes a display.

BRIEF DESCRIPTION OF THE DRAWINGS

To provide a more complete understanding of the present disclosure and features and advantages thereof, reference is made to the following description, taken in conjunction with the accompanying figures, wherein like reference numerals represent like parts, in which.

The FIGURES of the drawings are not necessarily drawn to scale, as their dimensions can be varied considerably without departing from the scope of the present disclosure.

DETAILED DESCRIPTION

The following detailed description sets forth examples of apparatuses, methods, and systems relating to enabling the synchronization between one or more display panels and a display engine in accordance with an embodiment of the present disclosure. Features such as structure(s), function(s), and/or characteristic(s), for example, are described with reference to one embodiment as a matter of convenience; various embodiments may be implemented with any suitable one or more of the described features.

In the following description, various aspects of the illustrative implementations will be described using terms commonly employed by those skilled in the art to convey the substance of their work to others skilled in the art. However, it will be apparent to those skilled in the art that the embodiments disclosed herein may be practiced with only some of the described aspects. For purposes of explanation, specific numbers, materials, and configurations are set forth in order to provide a thorough understanding of the illustrative implementations. However, it will be apparent to one skilled in the art that the embodiments disclosed herein may be practiced without the specific details. In other instances, well-known features are omitted or simplified in order not to obscure the illustrative implementations.

In the following detailed description, reference is made to the accompanying drawings that form a part hereof wherein like numerals designate like parts throughout, and in which is shown, by way of illustration, embodiments that may be practiced. It is to be understood that other embodiments may be utilized and structural or logical changes may be made without departing from the scope of the present disclosure. Therefore, the following detailed description is not to be taken in a limiting sense. For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B, and C). Reference to "one embodiment" or "an embodiment" in the present disclosure means that a particular feature, structure, or characteristic described in connection with the embodiment is included in at least one embodiment. The appearances of the phrase "in one embodiment" or "in an embodiment" are not necessarily all referring to the same embodiment. The appearances of the phrase "for example," "in an example," or "in some examples" are not necessarily all referring to the same example. The term "about" includes a plus or minus fifteen percent (±15%) variation.

Figure 1:
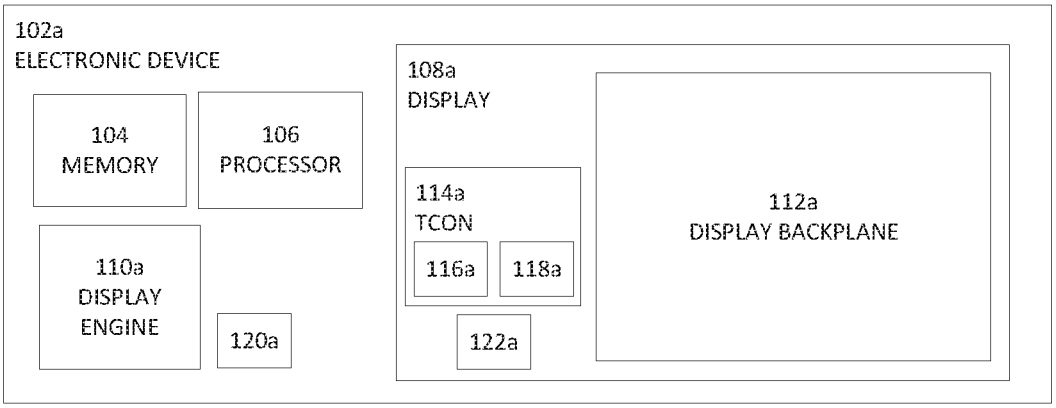
FIG. 1 is a simplified block diagram of a system to enable the synchronization between one or more display panels and a display engine, in accordance with an embodiment of the present disclosure.
Figure 1:
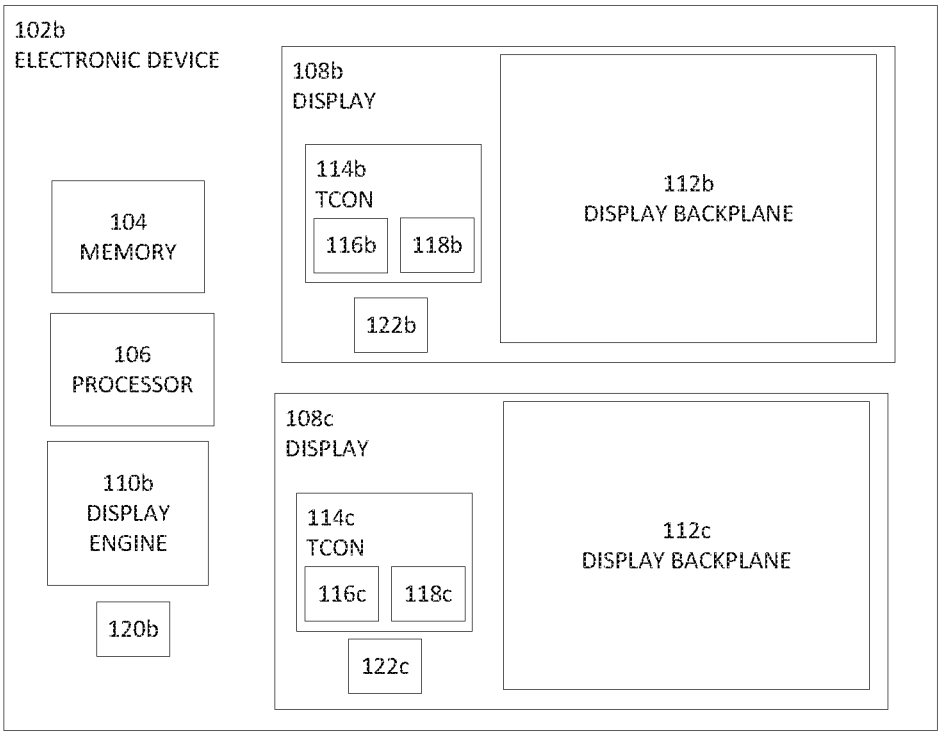

FIG. 1 is a simplified block diagram of electronic devices configured to enable the synchronization between one or more display panels and a display engine, in accordance with an embodiment of the present disclosure. In an example, an electronic device 102*a* can include memory 104, one or more processors 106, a display panel 108*a*, a display engine 110*a*, and a master clock 120*a*. Display panel 108*a* can include a display backplane 112*a*, a timing controller (TCON) 114*a*, and a local clock 122*a*. TCON 114*a* can include a remote frame buffer 116*a* and a synchronization engine 118*a*. An electronic device 102*b* can include memory 104, one or more processors 106, a display engine 110*b*, a master clock 120*b*, and a plurality of displays. For example, as illustrated in FIG. 1, electronic device 102*b* includes display panels 108*b* and 108*c*. Display panel 108*b* can include a display backplane 112*b*, a TCON 114*b*, and a local clock 122*b*. TCON 114*b* can include a remote frame buffer 116*b* and a synchronization engine 118*b*. Display panel 108*c* can include a display backplane 112*c*, a TCON 114*c*, and a local clock 122*c*. TCON 114*c* can include a remote frame buffer 116*c* and a synchronization engine 118*c*. Display backplanes 112*a*-112*c* can be an array of display pixels. In some examples, display backplanes 112*a*-112*c* are current display backplanes created using LCD, OLED, or other display technologies. Display engine 110*a* can be a processor, a core of a processor, part of a core of a processor, a dedicated graphics processor, a core of a graphics processor, part of a core of a graphics processor, a graphics engine, or source and located on a system on chip (SoC). Display engine 110*a* can be configured to help display an image on display panel 108*a*. Display engine 110*b* can be a processor, a core of a processor, part of a core of a processor, a dedicated graphics processor, a core of a graphics processor, part of a core of a graphics processor, a graphics engine, or source and located on a SoC. Display engine 110*b* can help display an image on display panel 108*b* and on display panel 108*c*. In an example, display panel 108*b* may have a first dedicated display engine or core of a display engine and display panel 108*c* may have a separate second dedicated display engine or core of a display engine.

Each of TCONs 114*a*-114*c* are a timing controller on the display side. Master clock 120*a* can be the system clock for electronic device 102*a*. Master clock 120*b* can be the system clock for electronic device 102*b*. Local clock 122*a* can be the clock for display panel 108*a* when display panel 108*a* is not using master clock 120*a*. Local clock 122*b* can be the clock for display panel 108*b* when display panel 108*b* is not using master clock 120*b*. Local clock 122*c* can be the clock for display panel 108*c* when display panel 108*c* is not using master clock 120*c*.

Display engine 110*a* is responsible for transforming mathematical equations into individual pixels and frames and communicating the individual pixel and frames to TCON 114*a*. TCON 114*a* receives the individual frames generated by display engine 110*a*, corrects for color and brightness, controls the refresh rate, controls power savings of display panel 108*a*, touch (if enabled), etc. TCON 114*a*, using synchronization engine 118*a*, can be configured to synchronize the video stream from TCON 114*a* with the video stream from display engine 110*a*.

Display engine 110*b* is responsible for transforming mathematical equations into individual pixels and frames and communicating the individual pixel and frames to TCON 114*b* and TCON 114*c*. TCON 114*b* receives the individual frames generated by display engine 110*b*, corrects for color and brightness, controls the refresh rate, controls power savings of display panel 108*b*, touch (if enabled), etc. TCON 114*c* receives the individual frames generated by display engine 110*b*, corrects for color and brightness, controls the refresh rate, controls power savings of display panel 108*c*, touch (if enabled), etc.

TCON 114*b*, using synchronization engine 118*b*, can be configured to synchronize the video stream from TCON 114*b* with the video stream from display engine 110*b*. Also, TCON 114*b*, using synchronization engine 118*b*, can be configured to synchronize the video stream from TCON 114*b* with the video stream from TCON 114*c*. TCON 114*c*, using synchronization engine 118*c*, can be configured to synchronize the video stream from TCON 114*c* with the video stream from display engine 110*b*. Also, TCON 114*c*, using synchronization engine 118*c*, can be configured to synchronize the video stream from TCON 114*c* with the video stream from TCON 114*b*

More specifically, each synchronization engine 118*a*-118*c* can be configured to both transmit their own timing information (e.g., in the form of a start of frame indicator or start of frame pulse as well as listen and react to other devices' timing information and cooperatively synchronize to each other. Most current video transmission systems typically employ a master/slave or asymmetric timing model where one device (e.g., a display engine) is the timing master, and the other device (e.g., TCON(s)) is the timing slave. In most current models, the master sends some form of timing information to the slave, which in turn aligns the generation or display of video data (i.e., frames) to the master. Most current systems require that the display continues to operate in the absence of data from the display engine and timing information (e.g., during PSR2), and they do so by using a local oscillator (e.g., local clock 122*b*) to generate the "correct" frame rate. However, as no two clocks are exactly the same frequency, the frame rate and latency of a video stream from a display will inevitably drift with respect to other displays. Also, when the display engine resumes generating video frames, it too will be unaligned with the display(s)

Each synchronization engine 118*a*-118*c* can be configured to provide a symmetrical synchronization mechanism. For example, synchronization engine 118*a* can communicate with display engine 110*a* to help provide low latency and relatively seamless glitch-free operation by helping to align the frame rate from TCON 114*a* with display engine 110*a*. In addition, synchronization engines 118*b* and 118*c* can communicate with each other and display engine 110*b* to help provide low latency and relatively seamless glitch-free operation by helping to align the frame rate from TCONs 114*b* and 114*c* with each other and with display engine 110*b*. In an example, synchronization engines 118*b* and 118*c* can communicate with each other and display engine 110*b* over a single interconnect. Each of synchronization engines 118*b* and 118*c* can be a master and a slave at the same time, where the master sends the synchronization signal (e.g., start of frame indicator or start of frame pulse) and the slave reacts to the synchronization signal. In a specific example, when a slave device detects the received synchronization signal and determines the received synchronization signal is not synchronized to its own synchronization signal, the slave device will increase or decrease the amount of vertical blanking lines over next one or more frame times until the video streams are synchronized.

In a specific example, this can allow the system to resolve the lack of synchronization concern of PSR2 display in low power mode (Short Loop) for both single and dual displays. In addition, the system can also offer a fast resynchronization solution for exit from a deep sleep for PSR2 displays. In an illustrative example, on exit from a PSR2 Deep Sleep, the display engine can be configured to wait for a synchronization signal from the synchronization engines in the display or displays before it starts to send a new frame in a video stream. By use of this mechanism, the display engine can become resynchronized to the TCON within one frame time.

It is to be understood that other embodiments may be utilized and structural changes may be made without departing from the scope of the present disclosure. Substantial flexibility is provided by an electronic device in that any suitable arrangements and configuration may be provided without departing from the teachings of the present disclosure.

As used herein, the term "when" may be used to indicate the temporal nature of an event. For example, the phrase "event 'A' occurs when event 'B' occurs" is to be interpreted to mean that event A may occur before, during, or after the occurrence of event B, but is nonetheless associated with the occurrence of event B. For example, event A occurs when event B occurs if event A occurs in response to the occurrence of event B or in response to a signal indicating that event B has occurred, is occurring, or will occur. Reference to "one embodiment" or "an embodiment" in the present disclosure means that a particular feature, structure, or characteristic described in connection with the embodiment is included in at least one embodiment. The appearances of the phrase "in one embodiment" or "in an embodiment" are not necessarily all referring to the same embodiment.

For purposes of illustrating certain example techniques of electronic devices 102*a* and 102*b*, the following foundational information may be viewed as a basis from which the present disclosure may be properly explained. Generally, a display panel (e.g., computer display, computer monitor, monitor, etc.) is an output device that displays information in pictorial form as a frame. A frame is a single still image created by a display engine for display on a display. The frame rate is the number or amount of these images that are displayed in one second. For a video, display engine will create a frame that is then combined in a rapid slideshow with other frames, each one slightly different, to achieve the illusion of natural motion. To produce, or render, a new frame, the display engine determines the physics, positions, and textures of the objects in the scene to produce an image. While a frame is displayed on the display, the frame is refreshed at a refresh rate. The refresh rate is the frequency that the image on the display is refreshed. The image on the display is typically refreshed sixty (60) times a second or higher (e.g., one-hundred and twenty (120) times a second for a 120 Hz display). A TCON will receive data from the display engine and the TCON is responsible for turning off and on the pixels that will generate the image. For non panel self-refresh (PSR) displays, if there is no new data received from the display engine, the display will still refresh at sixty (60) Hz per second because the pixels in the display will decay away if not refreshed.

More specifically, a display engine (e.g., computer processing unit (CPU), graphics processing unit (GPU), video processor, etc.) communicates with a TCON and the TCON is configured to drive the display. Most video processors communicate with the TCON using the Embedded DisplayPort (eDP) specification. The eDP specification was developed to be used specifically in embedded display applications such as laptops, notebook computers, desktops, all-in-one personal computers, etc. The display engine needs to keep sending video signals to the TCON at a constant rate. This rate, known as refresh rate or vertical frequency, is at least sixty (60) Hz. This can consume a relatively large amount of power so panel PSR was developed to save power for full-screen images. The idea behind PSR is to shut down the display engine and associated circuitry when the image to be displayed on a display is static. More specifically, most current TCONs include a frame buffer and the frame buffer in the TCON can maintain a display image without receiving video data from the display engine. For a static image, this allows the display engine to enter a low-power state. Allowing the display engine to power down between display updates to save power and extend the battery life.

Panel self-refresh with selective update (PSR2) is a superset of the panel self-refresh feature and it allows for the transmission of modified areas within a video frame and a low latency self-refresh state. PSR2 identifies when only a portion of the screen is static, which is a selective update. The PSR2 is a feature that TCON vendors can choose to include in their timing controller chips. It is a specification and part of the eDP specification. PSR2 requires the display panel to have a frame buffer and if the display panel has a frame buffer, then the display panel can perform a self-refresh using the frame buffer when the PSR2 mode is enabled.

PSR2 enabled display panels provide significant power savings over non-PSR enabled display panels, but it does not offer the low latency of a non-PSR display panel. Systems need to deliver both lower latency and lower power consumption. The current PSR2 display panels cannot guarantee low latency because the display engine lacks synchronization with the display panel in low power states (e.g., PSR2 Short Loop). Increasing the display refresh rate can reduce the display pipeline latency, however, that will increase the display power and lower the battery life. For dual display systems where an image can span both screens of two displays, it is important that both of the display panels have a synchronous refresh cycle to deliver a user experience of one big display across the two physical displays. Also, other desktop applications like full screen video playback, gaming, inking (stylus), and touch will require a synchronous refresh to maintain a seamless user experience across dual displays.

An issue with current systems is the lack of time synchronization between the display engine and the display in a PSR2 Short Loop. More specifically, as per the embedded display panel (eDP) specification, in PSR2 Short Loop (low power mode), the display engine and the display panel TCON operate using their own timing generator (e.g., the display engine may operate using a master clock and the TCON will operate using a local clock). The updated scanlines are scanned out by display engine at the timing of respective dirty scanlines (e.g., the updated scanlines in the frame or portion of the frames with an update or updates) or one line in advance (per eDP 1.4b spec., section 6.4.2). As a result, there is no time synchronization sent by the display engine to the TCON in the PSR2 Short Loop because, during the PSR2 Short Loop, the start of the frame is not been sent by the display engine. Additionally, the clock for the display engine and the clock for the TCON can drift over time, resulting in misalignment and increased latency. In order to account for this drift, the TCON operates a couple of scanlines behind the display engine, but this is not a foolproof solution if there is a high residency in the PSR2 Short Loop. The advantage of operating in the PSR2 Short Loop is that the display engine does not have to incur the penalty of long loop (fetch full frames) on exit from a PSR2 Deep Sleep. The higher residency in the PSR2 Short Loop increases the chance that the display engine and TCON can drift beyond the offset scanlines, resulting in up to a frame of latency in displaying the new updates. This frame latency will remain in the display pipeline until a resynchronization occurs.

Another issue with current systems is the lack of time synchronization between the display engine and both display panels for dual display systems in the PSR2 Short Loop. In the example where the display engine is driving both displays for every frame time (e.g., non-PSR, or long loop for PSR2), the synchronization can be achieved by driving both of the eDP ports from the display engine with a common timing generator. That means the display engine drives the frames and they are synchronized on both displays. But in the PSR2 Short Loop, there is no time synchronization information that has been shared between the display engine and both of the display panels. As a result, there is no way to guarantee synchronization between the displays in the in the PSR2 Short Loop. Additionally, in the PSR2 Short Loop, both the display panels can drift differently.

Yet another issue with current systems is the lack of a fast resynchronization on exit from a PSR2 Deep Sleep. As per the eDP 1.4b specification, on exit from the PSR2 Deep Sleep, the display panels must resynchronize with the display engine which can take a couple of frame times. In the case of some displays, this can take up to three frame times to resynchronize. The issue with resynchronization is that every time it occurs, there is additional power consumption on both the display engine and the display panel which negatively impacts power consumption.

One current solution to the above issues is to use a global timing controller defined by the eDP 1.4a specification. As per the eDP specification, in the PSR2 Short Loop, the display engine and TCON are required to maintain synchronization, which according to the eDP specification, can be accomplished by using a global timing controller that sends clock pulses every ten (10) milliseconds. Use of the global timing controller completely diminishes the PSR2 power savings as the source must send the clock signal every ten (10) milliseconds, hence the display engine cannot enter low power state. Therefore, most current display panels are not using the global timing controller for time synchronization due to the increase in power or inability to go into a reduced power state.

Another current solution, is to use an eDP port synchronization feature for dual displays. The eDP port synchronization feature for dual display allows eDP ports to be driven by a common timing generator. This will ensure both the eDP ports are synchronized in a PSR2 reset and capture state. However, this approach cannot assure synchronizations in the PSR2 Short Loop and PSR2 Deep Sleep states. What is needed is system and method that can help to synchronize one or more display panels and a display engine.

A system and method to help the synchronization between one or more display panels and a display engine can resolve these issues (and others). In an example, an electronic device (e.g., electronic device 102*a*) can include one or more TCONS and each TCON can include a synchronization engine (e.g., TCON 114*a* includes synchronization engine 118*a*, TCON 114*b* includes synchronization engine 118*b*, and TCON 114*c* includes synchronization engine 118*c*). The synchronization engine can allow a TCON to be both a master and a slave simultaneously, and to transmit as well as receive and react to timing information such that video frames are generated and displayed at the same rate or frames per second and with the desired time alignment (latency). In the system, there is no distinction between video sources and video sinks from a timing perspective.

Symmetric synchronization provides a means for display engines and TCONs to cooperatively synchronize to each other using only a single wired-OR (WOR) signal that all devices use to both transmit their own timing information (in the form of a start of frame indicator or a start of frame pulse) as well as listen and react to all other devices' timing information. In order to react to other devices' timing information, a device must have a degree of freedom to change its own frame rate. This is done by modifying the number of vertical blanking lines that the device uses. In addition to a nominal number of vertical blanking lines, each device is programmed with a minimum number of vertical blanking lines and maximum number of allowed vertical blanking lines. The number of vertical blanking lines between the minimum vertical blanking lines and the maximum vertical blanking lines is a vertical blanking lines range and indirectly specifies an allowed frames per second range for the device.

Within a frame, there are active lines and vertical blanking lines. The amount of active lines determines the active frame time and the amount of vertical blanking lines determines the vertical blanking interval. The active frame lines are the scan lines of a video signal that contain picture information. Most, if not all of the active frame lines are visible on a display. The vertical blanking interval, also known as the vertical interval, or VBLANK, is the time between the end of the final visible line of a frame (e.g., the active frame lines) and the beginning of the first visible line of the next frame. The vertical blanking interval is present in analog television, VGA, DVI, and other signals.

The vertical blanking interval was originally needed because in a cathode ray tube monitor, the inductive inertia of the magnetic coils which deflect the electron beam vertically to the position being drawn could not change instantly and time needed to be allocated to account for the time necessary for the position change. Additionally, the speed of older circuits was limited. For horizontal deflection, there is also a pause between successive lines, to allow the beam to return from right to left, called the horizontal blanking interval. Modern CRT circuitry does not require such a long blanking interval, and thin panel displays require none, but the standards were established when the delay was needed and to allow the continued use of older equipment. In analog television systems the vertical blanking interval can be used for datacasting to carry digital data (e.g., various test signals, time codes, closed captioning, teletext, CGMS-A copy-protection indicators, various data encoded by the XDS protocol (e.g., content ratings for V-chip use), etc.), during this time period. The pause between sending video data is sometimes used in real time computer graphics to modify the frame buffer or to provide a time reference to allow switching the source buffer for video output without causing a visible tear in the displayed image.

For all video devices to synchronize and converge on a common frames per second, the intersection of the frames per second ranges for all devices cannot be null and there must be a frames per second value or range common to all devices. There is one exception to this requirement where a device may run at a subharmonic (1/N, where N=2, 3, 4, etc.) ratio to the common frames per second value. For example, if all devices were running at sixty (60) frames per second, it would be possible for one device to operate at thirty (30) frames per second, twenty (20) frames per second, fifteen (15) frames per second, etc., and still remain synchronized. If multiple devices run at a subharmonic frequency, every device's frequency must be a subharmonic of every other device. For example, if one device is operating at sixty (60) frames per second, other devices may operate at thirty (30) frames per second or twenty (20) frames per second, but not both simultaneously because twenty (20) frames per second is not a subharmonic of thirty (30) frames per second. One device could operate at thirty (30) frames per second and another device may operate at fifteen (15) frames per second however, because $30/60=1/2$, $20/60=1/3$, and $15/30=1/2$. A master-only device cannot react to other devices. In other words, the master-only device's frames per second range is a self-determined single point. Considering oscillator errors, it can be envisioned that if more than one device is configured as a master-only device, the intersection of frames per second ranges for the master devices will be a null set.

The theoretical maximum number of vertical blanking lines that can be removed from a frame is the amount that would result in no remaining vertical blanking. There is no theoretical maximum number of vertical blanking lines that can be added. (There is of course a practical limit to the maximum number of vertical blanking lines based on the minimum allowable frame rate, panel technology, etc.) The result of this is that typically, devices have a much greater ability to reduce their frame rate than increase it, which makes synchronizing two devices more difficult. One way to allow a device to increase its frame rate is to use a faster than required pixel clock for a given resolution and frames per second and add more nominal vertical blanking lines to achieve the correct nominal frame rate. Having a larger number of vertical blanking lines allows the difference between minimum number of vertical blanking lines and the amount that would result in no remaining vertical blanking lines to be larger. This technique may also provide some "race to halt" power savings at various points.

It is possible to configure the system to seek a common frame rate where all devices are as close to the nominal frame rate as possible or all the devices are as close to the minimum frame rate as possible. PSR/PSR2 is an example of a use case where seeking the lowest frame rate is the desired approach. If the displays are simply re-displaying the same data, it makes sense from a power optimization perspective to do that as infrequently as possible while still keeping all the displays synchronized to each other.

In an illustrative example, each device, if it is enabled as a master device, communicates its start of frame pulse to all devices. In an example, the start of frame pulse can be communicated to a wired-OR sync signal that is common to all devices. Each device, if it enabled as a slave device, passes other devices' start of frames pulses to a synchronization engine that determines the amount of vertical blanking lines. At the start of the frame, each device initializes its own vertical blanking line value to the nominal value. Also at the start of the frame, each device starts a timer or reads a time or value from a clock (e.g., masker clock 120*a* or local clock 122*a*), and if another device's start of frame is seen during the first half of the frame, the device adds the value of the timer or the current time or value from the clock minus the time at the start of the frame to the number of vertical blanking lines (or adds the maximum number of vertical blanking lines, whichever is less) to the end of a frame. During the second half of the frame, each device stops incrementing the timer but continues to monitor other devices' start of frame signals. If another device's start of frame is detected during the second half the frame, the device sets the number of vertical blanking lines to the minimum number of vertical blanking lines. The same basic system could be adapted to work on a per-line basis by adjusting the horizontal blanking times instead of a per-frame basis by adjusting the amount of vertical blanking lines.

In an example implementation, electronic devices 100*a* and 100*b* are meant to encompass an electronic device that includes a display, especially a computer, laptop, electronic notebook, hand held device, wearables, network elements that have a display, or any other device, component, element, or object that has an a display where frame rates need to by synchronized or aligned. Electronic devices 100*a* and 100*b* may include any suitable hardware, software, components, modules, or objects that facilitate the operations thereof, as well as suitable interfaces for receiving, transmitting, and/or otherwise communicating data or information in a network environment. This may be inclusive of appropriate algorithms and communication protocols that allow for the effective exchange of data or information. Electronic devices 100*a* and 100*b* may include virtual elements.

Electronic devices 100*a* and 100*b* may include any suitable hardware, software, components, modules, or objects that facilitate the operations thereof, as well as suitable interfaces for receiving, transmitting, and/or otherwise communicating data or information in a network environment. This may be inclusive of appropriate algorithms and communication protocols that allow for the effective exchange of data or information. Electronic devices 100*a* and 100*b* may include virtual elements.

In regards to the internal structure associated with electronic devices 100*a* and 100*b*, electronic devices 100*a* and 100*b* can include memory elements for storing information to be used in the operations outlined herein. Electronic devices 100*a* and 100*b* may keep information in any suitable memory element (e.g., random access memory (RAM), read-only memory (ROM), erasable programmable ROM (EPROM), electrically erasable programmable ROM (EEPROM), application specific integrated circuit (ASIC), etc.), software, hardware, firmware, or in any other suitable component, device, element, or object where appropriate and based on particular needs. Any of the memory items discussed herein should be construed as being encompassed within the broad term 'memory element.' Moreover, the information being used, tracked, sent, or received in electronic devices 100*a* and 100*b* could be provided in any database, register, queue, table, cache, control list, or other storage structure, all of which can be referenced at any suitable timeframe. Any such storage options may also be included within the broad term 'memory element' as used herein.

In certain example implementations, the functions outlined herein may be implemented by logic encoded in one or more tangible media (e.g., embedded logic provided in an ASIC, digital signal processor (DSP) instructions, software (potentially inclusive of object code and source code) to be executed by a processor, or other similar machine, etc.), which may be inclusive of non-transitory computer-readable media. In some of these instances, memory elements can store data used for the operations described herein. This includes the memory elements being able to store software, logic, code, or processor instructions that are executed to carry out the activities described herein.

In an example implementation, elements of electronic devices 100*a* and 100*b* may include software modules (e.g., display engines 110*a* and 110*b*, TCONs 114*a*-114*c*, synchronization engine 118*a*-118*c*, etc.) to achieve, or to foster, operations as outlined herein. These modules may be suitably combined in any appropriate manner, which may be based on particular configuration and/or provisioning needs. In example embodiments, such operations may be carried out by hardware, implemented externally to these elements, or included in some other network device to achieve the intended functionality. Furthermore, the modules can be implemented as software, hardware, firmware, or any suitable combination thereof. These elements may also include software (or reciprocating software) that can coordinate with other network elements in order to achieve the operations, as outlined herein.

Additionally, electronic devices 100*a* and 100*b* may include one or more processors that can execute software or an algorithm to perform activities as discussed herein. A processor can execute any type of instructions associated with the data to achieve the operations detailed herein. In one example, the processors could transform an element or an article (e.g., data) from one state or thing to another state or thing. In another example, the activities outlined herein may be implemented with fixed logic or programmable logic (e.g., software/computer instructions executed by a processor) and the elements identified herein could be some type of a programmable processor, programmable digital logic (e.g., a field programmable gate array (FPGA), an erasable programmable read-only memory (EPROM), an electrically erasable programmable read-only memory (EEPROM)) or an ASIC that includes digital logic, software, code, electronic instructions, or any suitable combination thereof. Any of the potential processing elements, modules, and machines described herein should be construed as being encompassed within the broad term 'processor.'

Implementations of the embodiments disclosed herein may be formed or carried out on a substrate, such as a non-semiconductor substrate or a semiconductor substrate. In one implementation, the non-semiconductor substrate may be silicon dioxide, an inter-layer dielectric composed of silicon dioxide, silicon nitride, titanium oxide and other transition metal oxides. Although a few examples of materials from which the non-semiconducting substrate may be formed are described here, any material that may serve as a foundation upon which a non-semiconductor device may be built falls within the spirit and scope of the embodiments disclosed herein.

In another implementation, the semiconductor substrate may be a crystalline substrate formed using a bulk silicon or a silicon-on-insulator substructure. In other implementations, the semiconductor substrate may be formed using alternate materials, which may or may not be combined with silicon, that include but are not limited to germanium, indium antimonide, lead telluride, indium arsenide, indium phosphide, gallium arsenide, indium gallium arsenide, gallium antimonide, or other combinations of group III-V or group IV materials. In other examples, the substrate may be a flexible substrate including 2D materials such as graphene and molybdenum disulphide, organic materials such as pentacene, transparent oxides such as indium gallium zinc oxide poly/amorphous (low temperature of dep) III-V semiconductors and germanium/silicon, and other non-silicon flexible substrates. Although a few examples of materials from which the substrate may be formed are described here, any material that may serve as a foundation upon which a semiconductor device may be built falls within the spirit and scope of the embodiments disclosed herein.

The terms "over," "under," "below," "between," and "on" as used herein refer to a relative position of one layer or component with respect to other layers or components. For example, one layer or component disposed over or under another layer or component may be directly in contact with the other layer or component or may have one or more intervening layers or components. Moreover, one layer or component disposed between two layers or components may be directly in contact with the two layers or components or may have one or more intervening layers or components. In contrast, a first layer or first component "directly on" a second layer or second component is in direct contact with that second layer or second component. Similarly, unless explicitly stated otherwise, one feature disposed between two features may be in direct contact with the adjacent features or may have one or more intervening layers.

Figure 2:
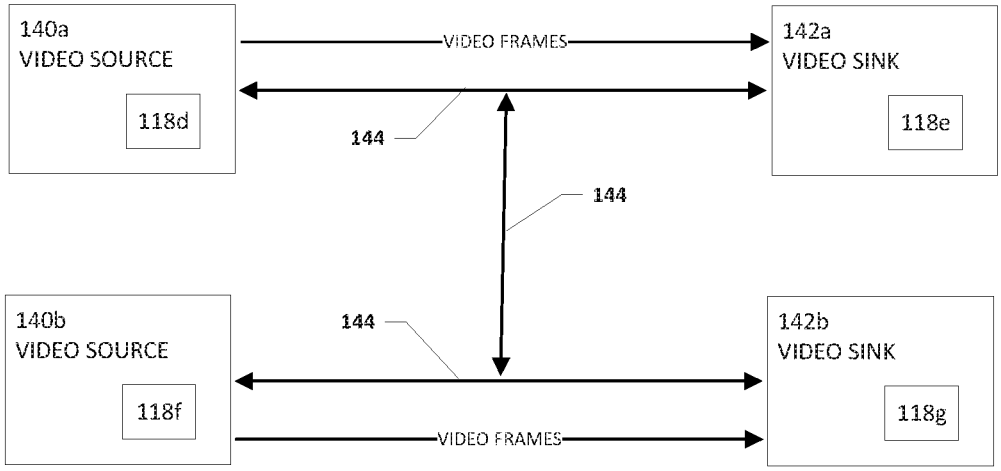
FIG. 2 is a simplified block diagram illustrating example details of a portion of a system to enable the synchronization between one or more display panels and a display engine, in accordance with an embodiment of the present disclosure.

Turning to FIG. 2, FIG. 2 is a simple block diagram illustrating example details of a system configured to enable the synchronization between one or more display panels and a display engine, in accordance with an embodiment of the present disclosure. As illustrated in FIG. 2, a video source 140*a* can communicate video frames to a video sink 142*a* and a video source 140*b* can communicate video frames to a video sink 142*b*. Each of video sources 140*a* and 140*b* may be a display engine, CPU, GPU, video processor, etc. Each of video sinks 142*a* and 142*b* may be a TCON. In some examples, video source 140*a* may communicate video frames to both video sinks 142*a* and 142*b* and video source 140*b* is not present. In some other examples, video source 140*a* may communicate video frames to both video sinks 142*a* and 142*b* and one or more other video sinks and video source 140*b* may communicate video frames to one or more additional video sinks. It should be noted that the example illustrated in FIG. 2 is for illustration purposes only and may be changed significantly and substantial flexibility is provided in that any suitable arrangements and configuration may be provided without departing from the teachings of the present disclosure.

Video source 140*a* can include a synchronization engine 118*d*, video source 140*b* can include a synchronization engine 118*f*, video sink 142*a* can include a synchronization engine 118*e*, and video sink 142*b* can include a synchronization engine 118*g*. Each synchronization engine 118*d*-118*g* can be configured to provide a symmetrical synchronization mechanism. More specifically, synchronization engines 118*d*-118*g* can communicate with each other over a single interconnect 144 to help synchronize frame rates. This provides a means for video sources 140*a* and 140*b* and video sinks 142*a* and 142*b* to cooperatively synchronize to each other using interconnect 144. In an example, interconnect 144 is a single wired-OR (WOR) signal that video sources 140*a* and 140*b* and video sinks 142*a* and 142*b* use to both transmit their own timing information (in the form of a start of frame indicator or a start of frame pulse) and receive timing information from the other devices.

Each of synchronization engines 118*d*-118*g* can be a master and a slave at the same time, where the master sends the synchronization signal (e.g., start of frame indicator or start of frame pulse) over interconnect 144 and the slave reacts to the synchronization signal. The lag time from when the synchronization signal is sent until it is received is relatively small and if frame rates are one (1) or two (2) scan lines apart they are still considered synchronized. In some examples, if frame rates are less than five (5) or ten (10) scan lines apart, they may be considered synchronized. If two devices send a synchronization signal at exactly the same time and neither device receives a synchronization signal from the other device, then the frame rates of the devices are considered synchronized. In a specific example, when a slave device detects the received synchronization signal and determines the received synchronization signal is not synchronized to its own synchronization signal, the slave device will increase or decrease the amount of vertical blanking lines over next one or more frame times until the video streams are synchronized. The amount of vertical blanking lines that can be added depends on the vertical blanking line range (e.g., vertical blanking line range 138 illustrated in FIG. 3).

In an illustrative example, at the start of the frame, each of video sources 140*a* and 140*b* and video sinks 142*a* and 142*b* initializes their own vertical blanking line value to the nominal value. Also at the start of the frame, each of video sources 140*a* and 140*b* and video sinks 142*a* and 142*b* start an internal timer or read a time or value from a clock (e.g., master clock 120*a* or local clock 122*a*), and if another device's start of frame is seen during the first half of the frame, the device adds the value of the timer or the current time or value from the clock minus the time at the start of the frame to the number of vertical blanking lines (or the maximum number of vertical blanking lines is added, whichever is less) at the end of a frame. During the second half of the frame, each of video sources 140*a* and 140*b* and video sinks 142*a* and 142*b* stop incrementing the timer but continue to monitor other devices' start of frame signals. If another device's start of frame is detected during the second half the frame, the minimum number of vertical blanking lines is added to the end of the frame.

Figure 3:
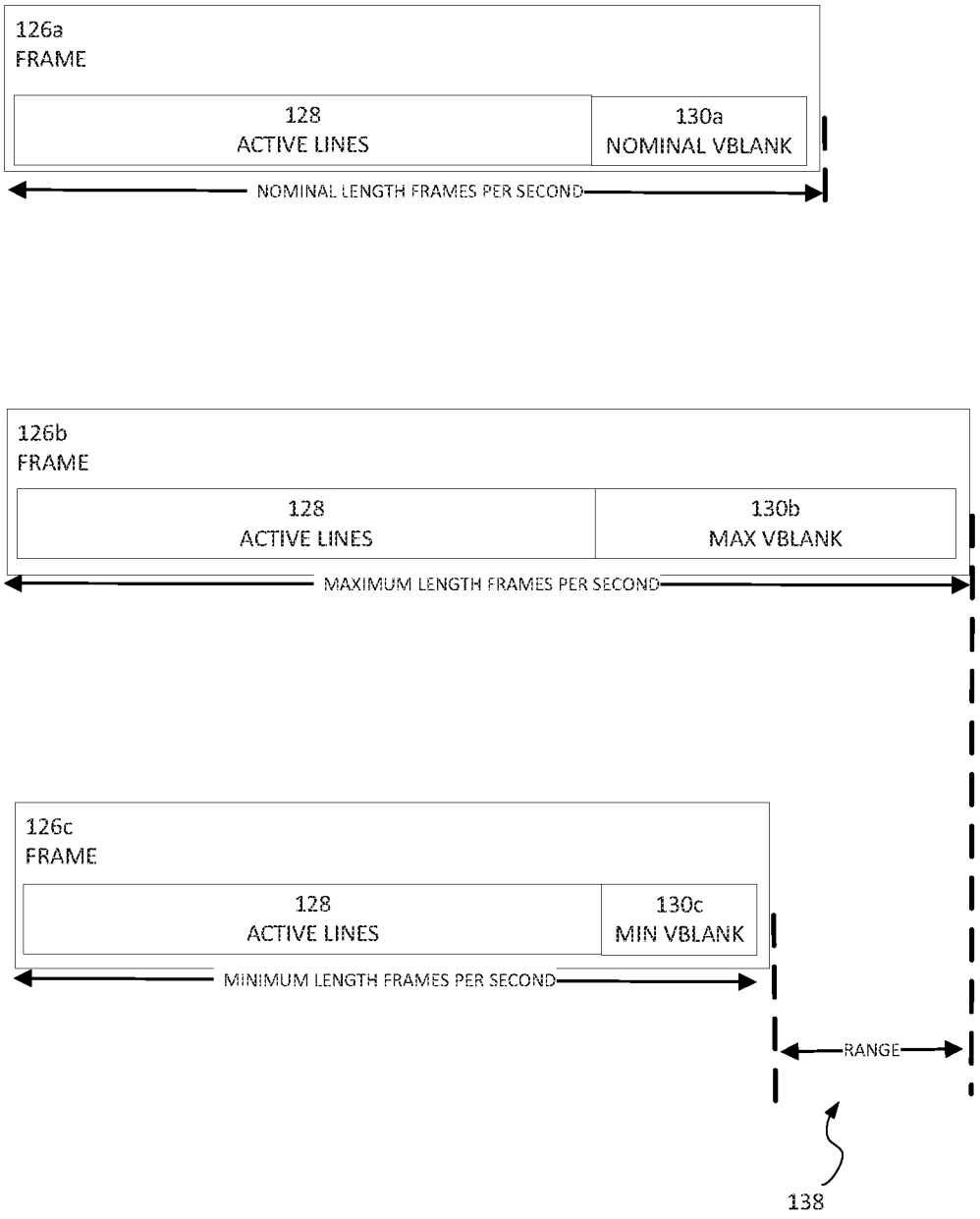
FIG. 3 is simplified block diagrams illustrating example details of a portion of a system to enable the synchronization between one or more display panels and a display engine, in accordance with an embodiment of the present disclosure.

Turning to FIG. 3, FIG. 3 is a simple block diagram illustrating a plurality of example frames that may be used in a system to help enable the synchronization of one or more display panels with a display engine. As illustrated in FIG. 3, a frame 126*a* can include an active lines portion 128 and a vertical blanking lines portion 130*a*, a frame 126*b* can include active lines portion 128 and a vertical blanking lines portion 130*b*, and a frame 126*c* can include active lines portion 128 and a vertical blanking lines portion 130*c*. Active lines portion 128 includes actives lines that are the scan lines of a video signal that contain picture information. Most, if not all of the active lines in active lines portion 128 are visible on a display. Vertical blanking lines portion 130*a*, vertical blanking lines portion 130*b*, and vertical blanking lines portion 130*c* include an amount of vertical blanking lines that are typically not visible on the display. Each of vertical blanking lines portion 130*a*, vertical blanking lines portion 130*b*, and vertical blanking lines portion 130*c* can include a different amount of vertical blanking lines. More specifically, vertical blanking lines portion 130*a* represent a nominal amount of vertical blanking lines. In an example, the nominal amount of vertical blanking lines for a 640×480 display panel is forty-five (45) blanking lines and the display panel would operate at sixty (60) Hz per second or sixty (60) frames per second. Vertical blanking lines portion 130*b* includes a maximum amount of vertical blanking lines. In an example, the maximum amount of vertical blanking lines for a 640×480 display panel may be five hundred and twenty-five (525) blanking lines on top of the forty-five (45) blanking lines for a total of five hundred and seventy (570) vertical blanking lines and the display panel would operate at thirty (30) Hz or thirty (30) frames per second and not sixty (60) Hz per second or sixty (60) frames per second. Vertical blanking lines portion 130*c* includes a minimum amount of vertical blanking lines. In an example, the minimum amount of vertical blanking lines for a 640×480 display panel is less than nominal vertical blanking (<60 Hz) and the display panel would operate at one (1) or two (2) frames more than nominal (>60 Hz) or sixty-one (61) frames per second or sixty-two (62) frames per second and not sixty (60) Hz per second or sixty (60) frames per second.

As illustrated in FIG. 3, the length of a frame can be adjusted by changing the amount of the vertical blanking lines. When the length of the frame is increased, the frame rate is decreased. When the length of the frame is decreased, the frame rate is increased. By adjusting the length of each frame in a video stream, the video stream of one or more display panels can be synchronized with the video stream from a display engine. More specifically, if the video streams are synchronized, frame 126*a* with nominal vertical blanking lines portion 130*a* can be used to create a nominal frame rate with a nominal number of frames per second. If a video stream is ahead of other video streams, frame 126*b* with maximum vertical blanking lines portion 130*b* can be used to create a minimum frame rate with a minimum number of frames per second. This will increase the time until the next frame is used in the video stream and slow the video stream down so it is no longer ahead of the other video streams. If a video stream is behind other video streams, frame 126*c* with minimum vertical blanking lines portion 130*c* can be used to create a maximum frame rate with a maximum number of frames per second. This will decrease the time until the next frame is used in the video stream and speed up the video stream so it is no longer behind the other video streams. The difference between the minimum vertical blanking lines and the maximum vertical blanking lines is the vertical blanking line range 138. Vertical blanking line range 138, or the number of vertical blanking lines between the minimum vertical blanking lines in a frame and the maximum vertical blanking lines in a frame can be adjusted to synchronize each of the video streams of one or more display panels with each other and/or with the video stream from the display engine. The number of vertical blanking lines used can be any number of vertical blanking lines within vertical blanking line range 138. The range indirectly specifies an allowed frames per second range. Note that a frame also includes horizontal blanking lines and the horizontal blanking lines can be adjusted similar to the vertical blanking lines to synchronize each of the video streams of one or more display panels with each other and/or with the video stream from the display engine.

Figure 4A:
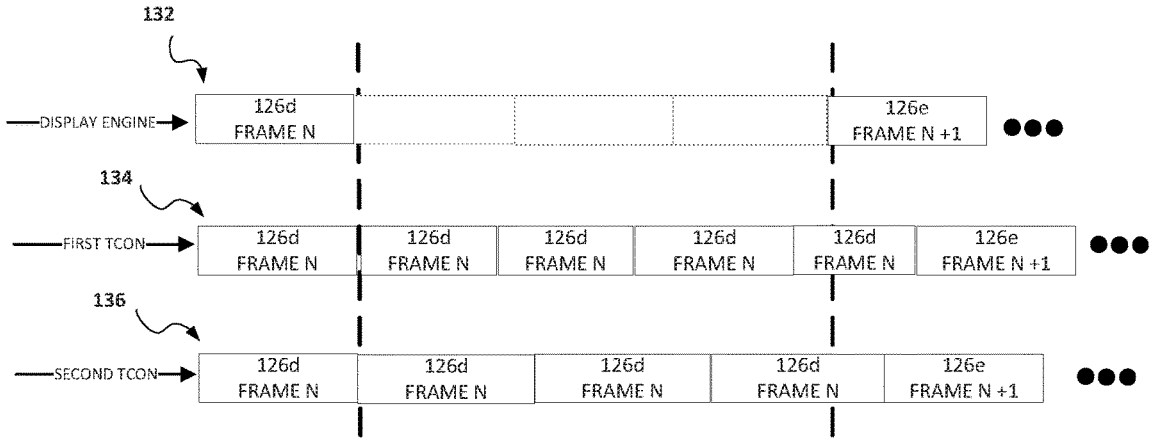
FIGS. 4A and 4B are simplified block diagrams illustrating example details of a portion of a system to enable the synchronization between one or more display panels and a display engine, in accordance with an embodiment of the present disclosure

Turning to FIG. 4A, FIG. 4A is a simple block diagram illustrating a plurality of example frames that may be used in a system to help enable the synchronization of one or more display panels with a display engine. As illustrated in FIG. 4A, a video stream from a display engine, a video stream from a first TCON, and a video steam from a second TCON are all synchronized. More specifically, a display engine video stream 132 from a display engine (e.g., display engine 110*b*) is synchronized with a first TCON video stream 134 from a first TCON (e.g., TCON 114*b*) and a second TCON video stream 136 from a second TCON (e.g., TCON 114*c*). The display engine may go into a low power mode and stop sending frames to the first TCON and the second TCON. For example, display engine can send frame 126*d* to the first TCON and the second TCON and then enter into a low power mode and not send any further frames. The first TCON and the second TCON can store frame 126*d* in a remote frame buffer, (e.g., remote frame buffer 116*b* and 116*c*) and continue to use frame 126*d* to refresh the display associated with each TCON. The image being displayed may be a static image where display engine does not need to send an updated or new frame to the first TCON and the second TCON because the image being displayed is not changing. When the image on the display is updated or changed, the display engine can send an updated or new frame 126*e* to the first TCON and the second TCON. However, in current systems, because the clocks of the first TCON and the second TCON are not perfectly synchronized with each other and/or with the clock of display engine, the timing of the video streams can be off and display engine video stream 132 may no longer be synchronized with first TCON video stream 134 and second TCON video stream 136. This can create problems because both the displays need to have a synchronous refresh cycle to deliver a user experience of one big display across the two physical displays. Also, other desktop applications like full screen video playback, gaming, inking (stylus), and touch will require a synchronous refresh to maintain a seamless user experience across dual displays. To help resynchronize first TCON video stream 134 and second TCON video stream 136 with display engine video stream 132, the number of vertical blanking lines can be adjusted to speed up or slow down the frame rates of each video stream. Note that the horizontal blanking lines can be adjusted similar to the vertical blanking lines to synchronize each of the video streams of one or more display panels with each other and/or with the video stream from the display engine.

Figure 4B:
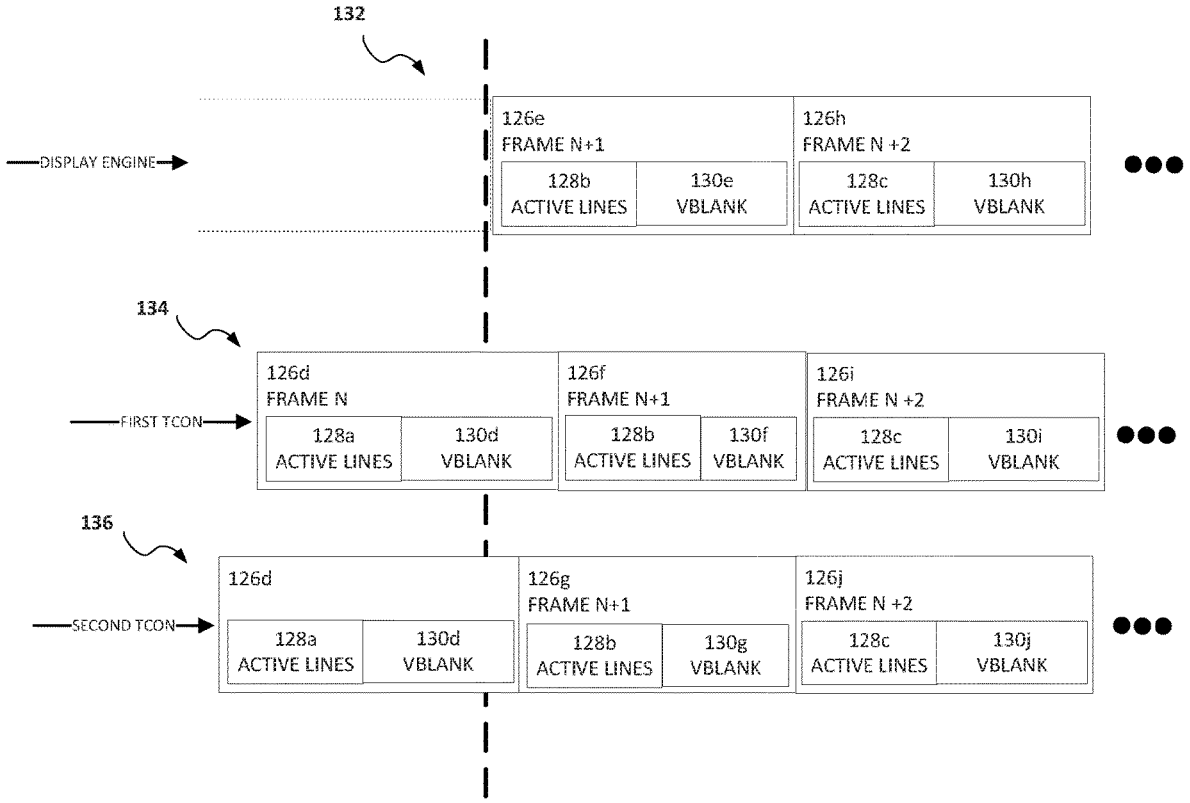

Turning to FIG. 4B, FIG. 4B is a simple block diagram illustrating a plurality of example frames that may be used in a system to help enable the synchronization of one or more display panels with a display engine. As illustrated in FIG. 4B, first TCON video stream 134 and second TCON video stream 136 are not synchronized with each other or with display engine video stream 132. In an example, synchronization engines 118*a*-118*c* can communicate with each other to help resynchronize the video streams. More specifically, a synchronization engine in the display engine (e.g., synchronization engine 118*a* in display engine 110*b*)

can communicate with a first synchronization engine in the first TCON (e.g., synchronization engine 118*b* in TCON 114*b*) and a second synchronization engine in the second TCON (e.g., synchronization engine 118*c* in TCON 114*c*). Each synchronization engine can be configured to add or subtract vertical blanking lines to frames until the frames are resynchronized. More specifically, to synchronize first TCON video stream 134 with display engine video stream 132, the first synchronization engine in the first TCON can subtract the number of vertical blanking lines from a nominal amount of vertical blanking lines to speed up the frame rate of first TCON video stream 134 and allow first TCON video stream 134 to become synchronized with display engine video stream 132. In addition, to synchronize second TCON video stream 136 with display engine video stream 132, the second synchronization engine in the second TCON can add the number of vertical blanking lines to a nominal amount of vertical blanking lines to slow down the frame rate of second TCON video stream 136 and allow second TCON video stream 136 to become synchronized with display engine video stream 132.

Figure 5:
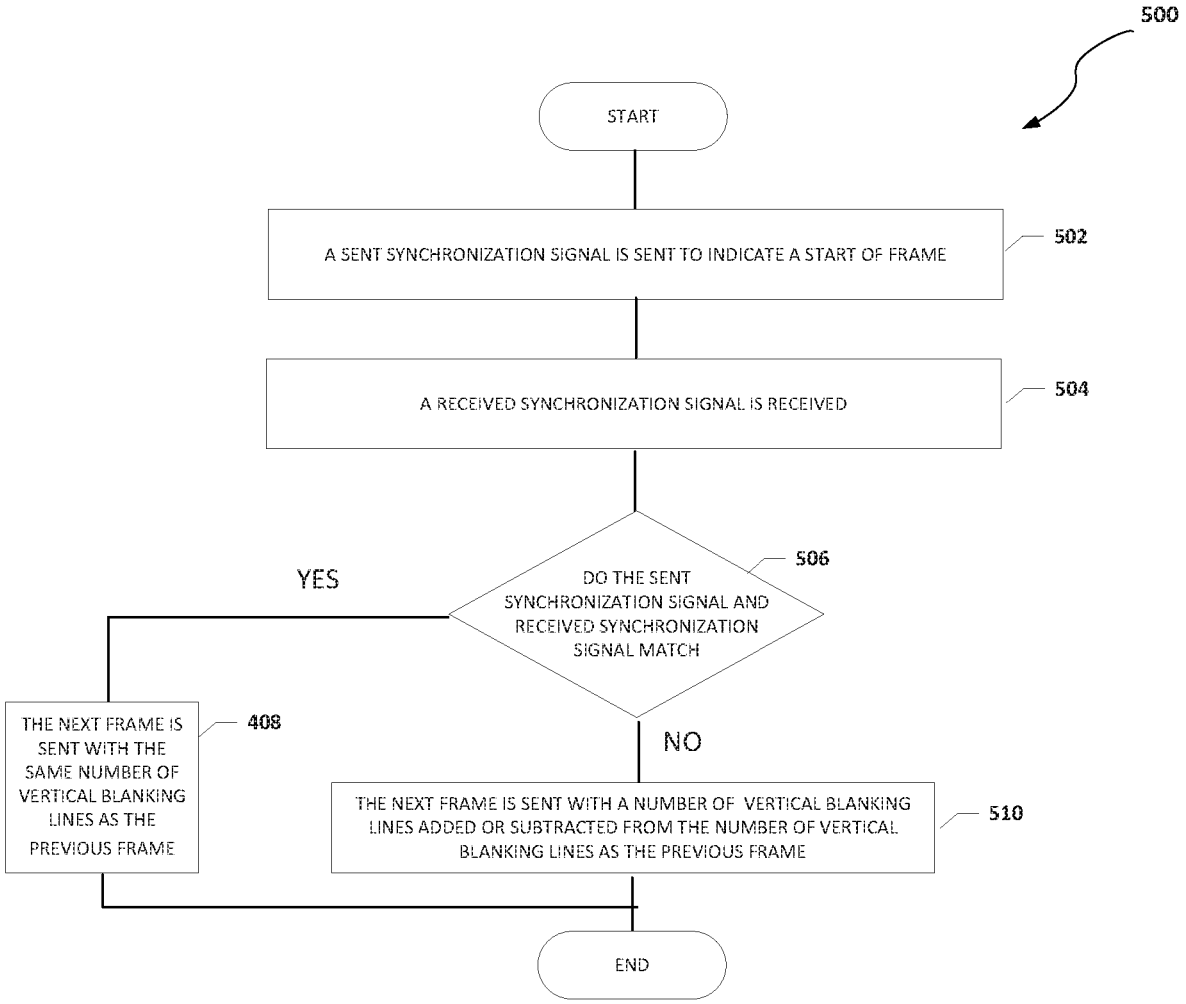
FIG. 5 is a simplified flowchart illustrating potential operations that may be associated with the system in accordance with an embodiment of the present disclosure.

Turning to FIG. 5, FIG. 5 is an example flowchart illustrating possible operations of a flow 500 that may be associated with enabling the synchronization of one or more display panels with a display engine, in accordance with an embodiment. In an embodiment, one or more operations of flow 500 may be performed by display engines 110*a* and 110*b*, TCONs 114*a*-114*c*, and synchronization engines 118*a*-118*c*. At 502, a sent synchronization signal is sent to indicate a start of a frame. At 504, a received synchronization signal is received. At 506, the system determines if the sent synchronization signal and received synchronization signal match. For example, each synchronization engine 118*a*-118*c* can analyze a sent synchronization signal and one or more received synchronization signals to determine if they match or were sent and received at about the same time or have the same or about the same time stamp. If there is a match, then the next frame is sent with the same number of blanking vertical lines as the previous frame, as in 508. If the sent synchronization signal matches the received synchronization signal, then that indicates that the video streams from the devices are synchronized. If there is not a match, then the next frame is sent with a number of blanking vertical lines added or subtracted from the number of vertical blanking lines as the previous frame, as in 510. For example, if the sent synchronization signal does not match the received synchronization signal, then that indicates that the video streams from the devices are not synchronized and vertical blanking lines can be added to the next frame sent to try and synchronize the video streams. More specifically, if a video stream is ahead of the other video streams, then vertical blanking lines can be added to the frame to slow down the video stream to try and synchronize the video streams. If the video stream is behind the other video streams, then vertical blanking lines can be subtracted from the frame to speed up the video stream to try and synchronize the video streams.

Figure 6:
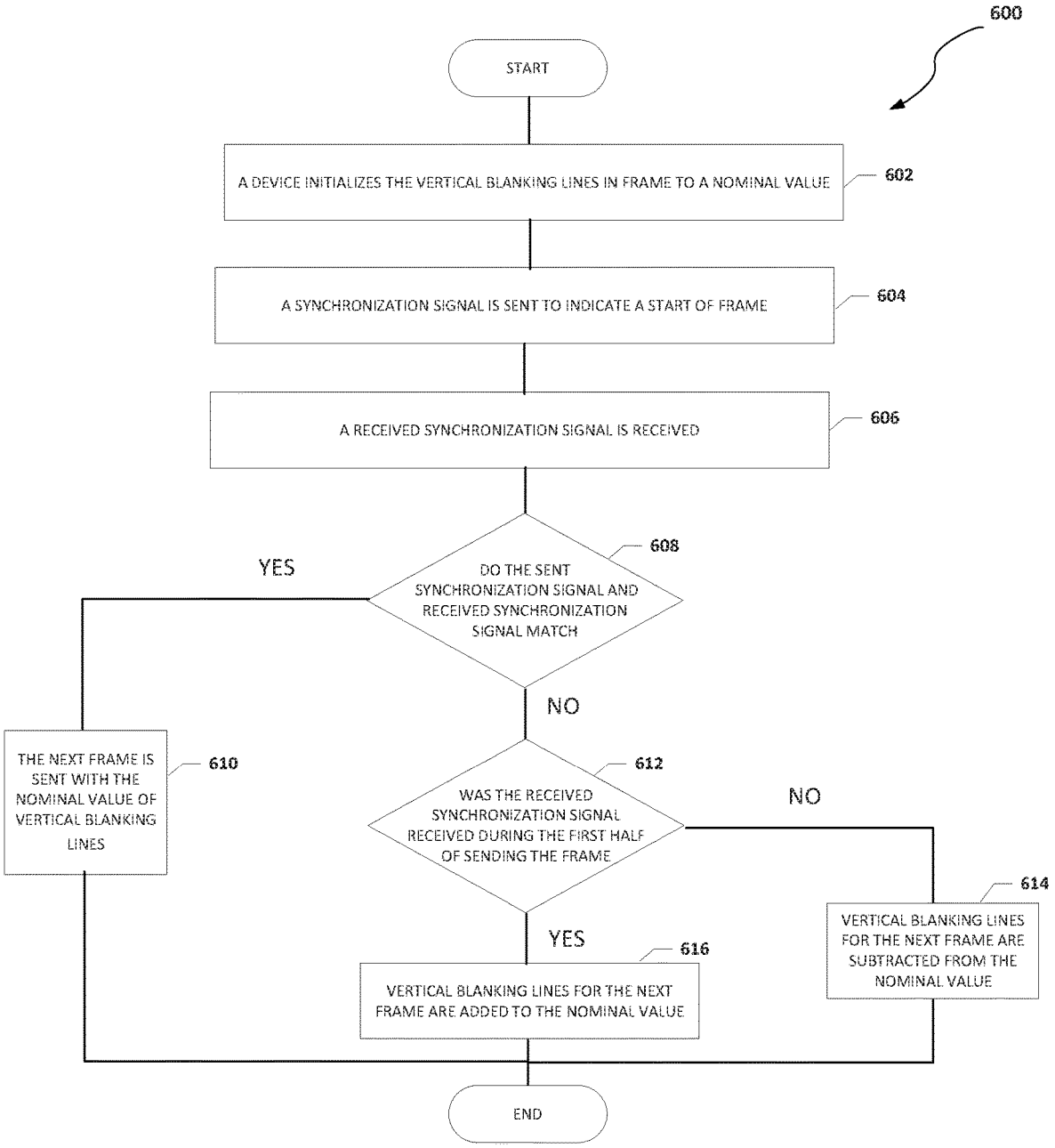
FIG. 6 is a simplified flowchart illustrating potential operations that may be associated with the system in accordance with an embodiment of the present disclosure.

Turning to FIG. 6, FIG. 6 is an example flowchart illustrating possible operations of a flow 600 that may be associated with enabling the synchronization of one or more display panels with a display engine, in accordance with an embodiment. In an embodiment, one or more operations of flow 600 may be performed by display engines 110*a* and 110*b*, TCONs 114*a*-114*c*, and synchronization engines 118*a*-118*c*. At 602, a device initializes the vertical blanking lines in a frame to a nominal value. At 604, a sent synchronization signal is sent to indicate a start of a frame. At 606, a received synchronization signal is received. At 608, the system determines if the sent synchronization signal and received synchronization signal match. For example, each synchronization engine 118*a*-118*c* can analyze a sent synchronization signal and one or more received synchronization signals to determine if they match or were sent and received at about the same time or have the same or about the same time stamp. If there is a match, then the next frame is sent with the nominal value of blanking vertical lines, as in 610. If there is not a match, then the system determines if the received synchronization signal was received during the first half of sending the frame in the video stream, as in 612. If the received synchronization signal was not received during the first half of sending the frame in the video stream, then vertical blanking lines for the next frame are subtracted from the nominal value, as in 614. If the received synchronization signal was received during the first half of sending the frame in the video stream, then vertical blanking lines for the next frame are added to the nominal value, as in 616.

Figure 7:
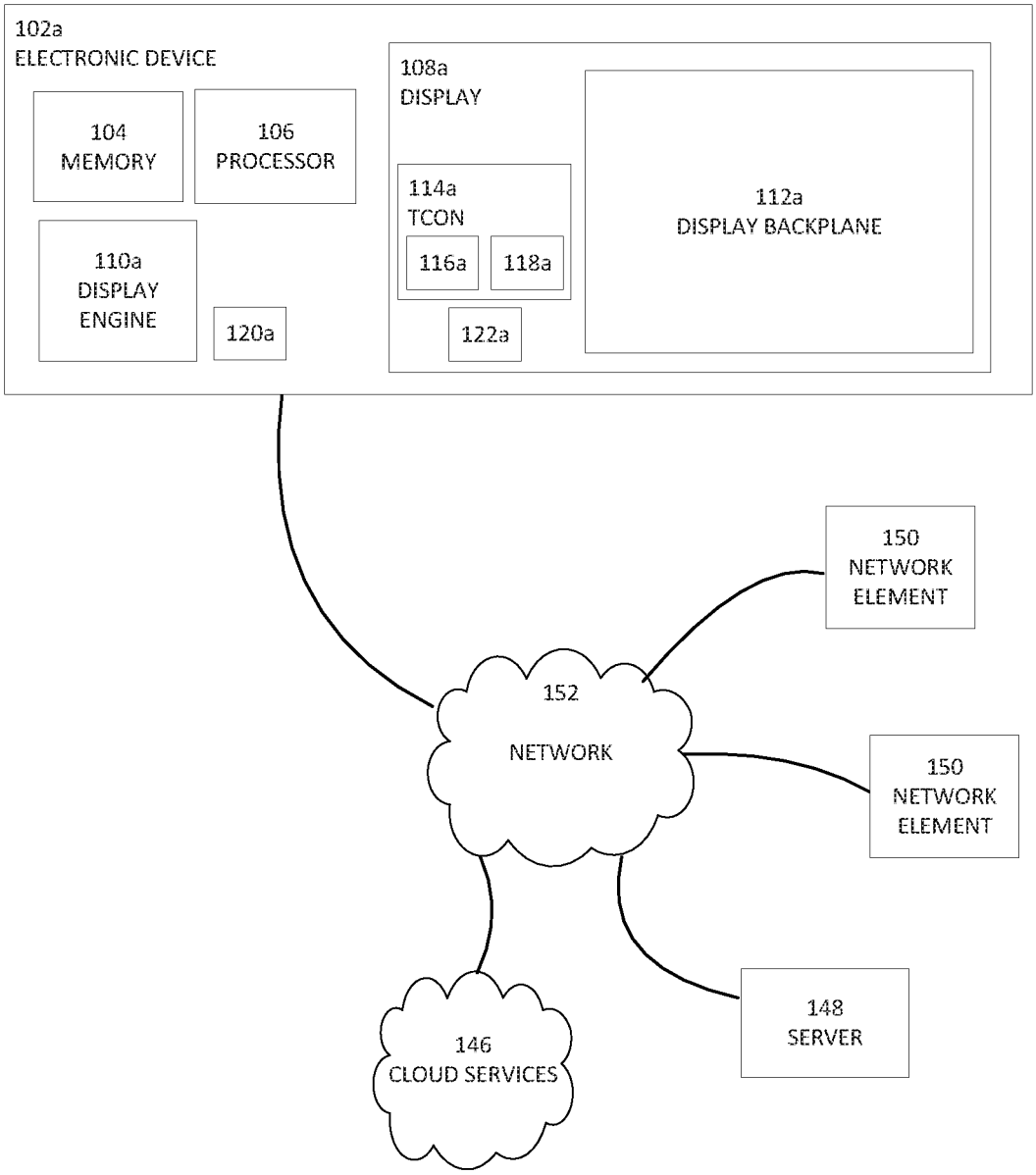
FIG. 7 is a simplified block diagram of an electronic device that includes a system to enable the synchronization between one or more display panels and a display engine, in accordance with an embodiment of the present disclosure.

Turning to FIG. 7, FIG. 7 is a simplified block diagram of electronic device 102*a* configured to enable synchronization of one or more display panels with a display engine, in accordance with an embodiment of the present disclosure. In an example, electronic device 102*a* can include memory 104, one or more processors 106, display panel 108*a*, display engine 110*a*, and master clock 120*a*. Display panel 108*a* can include display backplane 112*a*, and TCON 114*a*. TCON 114*a* can include remote frame buffer 116*a* and synchronization engine 118*a*.

Electronic device 102*a* (and electronic device 102*b*, not shown) may be a standalone device or in communication with cloud services 146, a server 148 and/or one or more network elements 150 using network 152. Network 152 represents a series of points or nodes of interconnected communication paths for receiving and transmitting packets of information. Network 152 offers a communicative interface between nodes, and may be configured as any local area network (LAN), virtual local area network (VLAN), wide area network (WAN), wireless local area network (WLAN), metropolitan area network (MAN), Intranet, Extranet, virtual private network (VPN), and any other appropriate architecture or system that facilitates communications in a network environment, or any suitable combination thereof, including wired and/or wireless communication.

In network 152, network traffic, which is inclusive of packets, frames, signals, data, etc., can be sent and received according to any suitable communication messaging protocols. Suitable communication messaging protocols can include a multi-layered scheme such as Open Systems Interconnection (OSI) model, or any derivations or variants thereof (e.g., Transmission Control Protocol/Internet Protocol (TCP/IP), user datagram protocol/IP (UDP/IP)). Messages through the network could be made in accordance with various network protocols, (e.g., Ethernet, Infiniband, OmniPath, etc.). Additionally, radio signal communications over a cellular network may also be provided. Suitable interfaces and infrastructure may be provided to enable communication with the cellular network.

The term "packet" as used herein, refers to a unit of data that can be routed between a source node and a destination node on a packet switched network. A packet includes a source network address and a destination network address. These network addresses can be Internet Protocol (IP) addresses in a TCP/IP messaging protocol. The term "data" as used herein, refers to any type of binary, numeric, voice, video, textual, or script data, or any type of source or object code, or any other suitable information in any appropriate format that may be communicated from one point to another in electronic devices and/or networks.

It is also important to note that the operations in the preceding diagrams illustrates only some of the possible scenarios and patterns that may be executed by, or within, electronic devices 100*a* and 100*b*. Some of these operations may be deleted or removed where appropriate, or these operations may be modified or changed considerably without departing from the scope of the present disclosure. In addition, a number of these operations have been described as being executed concurrently with, or in parallel to, one or more additional operations. However, the timing of these operations may be altered considerably. The preceding operational flows have been offered for purposes of example and discussion. Substantial flexibility is provided by electronic devices 100*a* and 100*b* in that any suitable arrangements, chronologies, configurations, and timing mechanisms may be provided without departing from the teachings of the present disclosure.

Although the present disclosure has been described in detail with reference to particular arrangements and configurations, these example configurations and arrangements may be changed significantly without departing from the scope of the present disclosure. Moreover, certain components may be combined, separated, eliminated, or added based on particular needs and implementations. Additionally, although electronic devices 100*a* and 100*b* have been illustrated with reference to particular elements and operations, these elements and operations may be replaced by any suitable architecture, protocols, and/or processes that achieve the intended functionality of electronic devices 100*a* and 100*b*. For example, instead of adjusting the vertical blanking lines or in addition to adjusting the vertical blanking lines, horizontal blanking lines may be adjusted to synchronize the video streams of one or more display panels with each other and/or with the video stream from a display engine.

Numerous other changes, substitutions, variations, alterations, and modifications may be ascertained to one skilled in the art and it is intended that the present disclosure encompass all such changes, substitutions, variations, alterations, and modifications as falling within the scope of the appended claims. In order to assist the United States Patent and Trademark Office (USPTO) and, additionally, any readers of any patent issued on this application in interpreting the claims appended hereto, Applicant wishes to note that the Applicant: (a) does not intend any of the appended claims to invoke paragraph six (6) of 35 U.S.C. section 112 as it exists on the date of the filing hereof unless the words "means for" or "step for" are specifically used in the particular claims; and (b) does not intend, by any statement in the specification, to limit this disclosure in any way that is not otherwise reflected in the appended claims.

OTHER NOTES AND EXAMPLES

In Example A1, a display panel can include a display, a timing controller, where the timing controller generates a video stream with a frame rate, and a synchronization engine, where the synchronization engine is configured to change the frame rate of the video stream by adding vertical blanking lines to or removing vertical blanking lines from one or more video frames in the video stream.

In Example A2, the subject matter of Example A1 can optionally include where the synchronization engine adds vertical blanking lines to decrease the frame rate of the video stream.

In Example A3, the subject matter of any one of Examples A1-A2 can optionally include where the synchronization engine removes vertical blanking lines to increase the frame rate of the video stream.

In Example A4, the subject matter of any one of Examples A1-A3 can optionally include where the display panel receives a synchronization signal from a display engine and adds or removes vertical blanking lines from one or more video frames in the video stream based on the synchronization signal.

In Example A5, the subject matter of any one of Examples A1-A4 can optionally include where the synchronization signal is a start of frame indicator from the display engine.

In Example A6, the subject matter of any one of Examples A1-A5 can optionally include where the display panel sends a synchronization signal to the display engine.

Example M1 is a method including determining a first frame rate of a first video stream from a display engine, determining a second frame rate of a second video stream from a timing controller in a display panel, and changing the second frame rate of the second video stream by adding vertical blanking lines to or removing vertical blanking lines from one or more video frames in the second video stream so the second frame rate of the second video stream matches the first frame rate of the first video stream.

In Example M2, the subject matter of Example M1 can optionally include where the display panel includes a display, the timing controller, and a synchronization engine, where the synchronization engine is configured to change the second frame rate of the second video stream by adding vertical blanking lines to or removing vertical blanking lines from one or more video frames in the second video stream.

In Example M3, the subject matter of any one of the Examples M1-M2 can optionally include adding vertical blanking lines to frames in the second video stream to decrease the second frame rate of the second video stream.

In Example M4, the subject matter of any one of the Examples M1-M3 can optionally include removing vertical blanking lines from frames in the second video stream to increase the second frame rate of the second video stream.

In Example M5, the subject matter of any one of the Examples M1-M4 can optionally include receiving a synchronization signal from the display engine, where the timing controller adds vertical blanking lines to or removes vertical blanking lines from one or more video frames in the second video stream based on the synchronization signal.

In Example, M6, the subject matter of any one of the Examples M1-M5 can optionally include where the synchronization signal is a start of frame indicator from the display engine.

In Example, M7, the subject matter of any one of the Examples M1-M6 can optionally include determining a third frame rate of a third video stream from a second timing controller in a second display panel, and changing the second frame rate of the second video stream by adding vertical blanking lines to or removing vertical blanking lines from one or more video frames in the second video stream so the second frame rate of the second video stream matches the third frame rate of the third video stream.

In Example, M8, the subject matter of any one of the Examples M1-M7 can optionally include sending a second synchronization signal to the second display panel and receiving a third synchronization signal from the second display panel.

Example S1 is a system for to synchronized a video stream of a display panel with the video stream of a display engine, the system including a display engine and a first display panel. The display engine generates a first video stream with a first frame rate. The first display panel that includes a first timing controller, where the first timing controller generates a second video stream of video frames with a second frame rate, and a first synchronization engine, where the first synchronization engine is configured to cause the first timing controller to change the second frame rate of the second video stream by adding vertical blanking lines to or removing vertical blanking lines from one or more video frames in the second video stream so the second frame rate of the second video stream matches the first frame rate of the first video stream.

In Example S2, the subject matter of Example S1 can optionally include a second display panel that includes a second timing controller, where the second timing controller generates a third video stream of video frames with a third frame rate, and a second synchronization engine, where the second synchronization engine is configured to cause the second timing controller to change the third frame rate of the third video stream by adding vertical blanking lines to or removing vertical blanking lines from one or more video frames in the third video stream so the third frame rate of the third video stream matches the first frame rate of the first video stream.

In Example S3, the subject matter of any one of the Examples S1-S2 can optionally include where the first synchronization engine adds vertical blanking lines to decrease the second frame rate of the second video stream.

In Example S4, the subject matter of any one of the Examples S1-S3 can optionally include where the first synchronization engine removes vertical blanking lines to increase the second frame rate of the second video stream.

In Example S5, the subject matter of any one of the Examples S1-S4 can optionally include where the first display panel receives a synchronization signal from the display engine and adds vertical blanking lines to or removes vertical blanking lines from frames in the second video stream based on the synchronization signal.

In Example S6, the subject matter of any one of the Examples S1-S5 can optionally include where the synchronization signal is a start of frame indicator from the display engine.

Example AA1 is an apparatus including means for determining a first frame rate of a first video stream from a display engine, means for determining a second frame rate of a second video stream from a timing controller in a display panel, and means for changing the second frame rate of the second video stream by adding vertical blanking lines to or removing vertical blanking lines from one or more video frames in the second video stream so the second frame rate of the second video stream matches the first frame rate of the first video stream.

In Example AA2, the subject matter of Example AA1 can optionally include where the display panel includes a display, the timing controller, and a synchronization engine, where the synchronization engine is configured to change the second frame rate of the second video stream by adding vertical blanking lines to or removing vertical blanking lines from one or more video frames in the second video stream.

In Example AA3, the subject matter of any one of Examples AA1-AA2 can optionally include means for adding vertical blanking lines to frames in the second video stream to decrease the second frame rate of the second video stream.

In Example AA4, the subject matter of any one of Examples AA1-AA3 can optionally include means for removing vertical blanking lines from frames in the second video stream to increase the second frame rate of the second video stream.

In Example AA5, the subject matter of any one of Examples AA1-AA4 can optionally include means for receiving a synchronization signal from the display engine, where the timing controller adds vertical blanking lines to or removes vertical blanking lines from one or more video frames in the second video stream based on the synchronization signal.

In Example AA6, the subject matter of any one of Examples AA1-AA5 can optionally include where the synchronization signal is a start of frame indicator from the display engine.

In Example AA7, the subject matter of any one of Examples AA1-AA6 can optionally include means for determining a third frame rate of a third video stream from a second timing controller in a second display panel, and means for changing the second frame rate of the second video stream by adding vertical blanking lines to or removing vertical blanking lines from one or more video frames in the second video stream so the second frame rate of the second video stream matches the third frame rate of the third video stream.

In Example AA8, the subject matter of any one of Examples AA1-AA7 can optionally include means for sending a second synchronization signal to the second display panel and receiving a third synchronization signal from the second display panel.

Example X1 is a machine-readable storage medium including machine-readable instructions to implement a method or realize an apparatus as in any one of the Examples A1-A7, M1-M8, or AA1-AA8. Example Y1 is an apparatus comprising means for performing any of the Example methods M1-M8. In Example Y2, the subject matter of Example Y1 can optionally include the means for performing the method comprising a processor and a memory. In Example Y3, the subject matter of Example Y2 can optionally include the memory comprising machine-readable instructions.

What is claimed is:

1. A display panel configured to enter and exit a low power mode, the display panel comprising:

a display;

a timing controller, wherein during the low power mode, the timing controller generates a video stream with a frame rate; and a synchronization engine, wherein, after exiting the low power mode, the synchronization engine receives a start of frame indicator from a display engine and, at least partially based on the start of frame indicator, is configured to change the frame rate of the video stream by adding vertical blanking lines to or removing vertical blanking lines from one or more video frames in the video stream.

2. The display panel of claim 1, wherein the synchronization engine adds vertical blanking lines to decrease the frame rate of the video stream.

3. The display panel of claim 1, wherein the synchronization engine removes vertical blanking lines to increase the frame rate of the video stream.

4. The display panel of claim 1, wherein the start of frame indicator is a synchronization signal from a display engine.

5. The display panel of claim 1, wherein the display panel sends a synchronization signal to the display engine.

6. A method comprising:

entering a low power mode where a timing controller in a display panel does not receive video data from a display engine;

exiting the low power mode;

determining a first frame rate of a first video stream from the display engine;

determining a second frame rate of a second video stream from the timing controller; and receiving a start of frame indicator from the display engine; and changing, based at least partially on the start of frame indicator, the second frame rate of the second video stream by adding vertical blanking lines to or removing vertical blanking lines from one or more video frames in the second video stream so the second frame rate of the second video stream matches the first frame rate of the first video stream.

7. The method of claim 6, wherein the display panel includes:

a display;

the timing controller; and a synchronization engine, wherein the synchronization engine is configured to change the second frame rate of the second video stream by adding vertical blanking lines to or removing vertical blanking lines from one or more video frames in the second video stream.

8. The method of claim 6, further comprising:

adding vertical blanking lines to frames in the second video stream to decrease the second frame rate of the second video stream.

9. The method of claim 6, further comprising:

removing vertical blanking lines from frames in the second video stream to increase the second frame rate of the second video stream.

10. The method of claim 6, wherein the start of frame indicator is a synchronization signal from the display engine, wherein the timing controller adds vertical blanking lines to or removes vertical blanking lines from one or more video frames in the second video stream based on the synchronization signal.

11. The method of claim 6, further comprising:

determining a third frame rate of a third video stream from a second timing controller in a second display panel; and changing the second frame rate of the second video stream by adding vertical blanking lines to or removing vertical blanking lines from one or more video frames in the second video stream so the second frame rate of the second video stream matches the third frame rate of the third video stream.

12. The method of claim 11, further comprising:

sending a second synchronization signal to the second display panel; and receiving a third synchronization signal from the second display panel.

13. A system to synchronize a video stream of a display panel with the video stream of a display engine, the system comprising:

the display engine, wherein the display engine can enter a low power mode where the display engine does not send video data to a first display panel and upon exit of the low power mode, the display engine generates a first video stream with a first frame rate;

the first display panel includes:

a first timing controller, wherein, when the display engine is in the low power mode and not sending video data to the first display panel, the first timing controller generates a second video stream of video frames with a second frame rate; and a first synchronization engine, wherein, when the display engine exits the low power mode and sends the first video stream with the first frame rate, the first synchronization engine is configured to receive a start of frame indicator from the display engine and, at least partially based on the start of frame indicator, cause the first timing controller to change the second frame rate of the second video stream by adding vertical blanking lines to or removing vertical blanking lines from one or more video frames in the second video stream so the second frame rate of the second video stream matches the first frame rate of the first video stream.

14. The system of claim 13, further comprising:

a second display panel that includes:

a second timing controller, wherein the second timing controller generates a third video stream of video frames with a third frame rate; and a second synchronization engine, wherein the second synchronization engine is configured to cause the second timing controller to change the third frame rate of the third video stream by adding vertical blanking lines to or removing vertical blanking lines from one or more video frames in the third video stream so the third frame rate of the third video stream matches the first frame rate of the first video stream.

15. The system of claim 13, wherein the first synchronization engine adds vertical blanking lines to decrease the second frame rate of the second video stream.

16. The system of claim 13, wherein the first synchronization engine removes vertical blanking lines to increase the second frame rate of the second video stream.

17. The system of claim 13, wherein the start of frame indicator is a synchronization signal from the display engine.

* * * * *